United States Patent [19]

Bolongeat-Mobleu et al.

[11] Patent Number: 4,562,321

[45] Date of Patent: Dec. 31, 1985

[54] GUIDING ASSEMBLY FOR A HIGH-VOLTAGE CIRCUIT-BREAKER OPERATING ROD

[75] Inventors: Roger Bolongeat-Mobleu, Echirolles; Thierry Busin; Jean-Paul Ravet, both of Grenoble, all of France

[73] Assignee: Merlin Gerin, Grenoble, France

[21] Appl. No.: 660,878

[22] Filed: Oct. 15, 1984

[30] Foreign Application Priority Data

Oct. 24, 1983 [FR] France ..... 83 17036

[51] Int. Cl.[4] ..... H01H 33/88

[52] U.S. Cl. ..... 200/148 A; 200/148 F

[58] Field of Search ..... 200/148 F, 148 R, 147 R, 200/146 R, 148 A

[56] References Cited

U.S. PATENT DOCUMENTS

| | | | |
|---|---|---|---|
| 2,238,567 | 4/1941 | Prince | 200/148 F |
| 3,657,495 | 4/1972 | Charamel et al. | 200/148 F |
| 4,016,383 | 4/1977 | Nicoloso | 200/148 F |
| 4,431,886 | 2/1984 | Logan | 200/147 R |

*Primary Examiner*—Robert S. Macon

*Attorney, Agent, or Firm*—Parkhurst & Oliff

[57] ABSTRACT

The operating rod 24 of a high-voltage puffer circuit-breaker is guided inside the support insulator 12 by insulator guides 40 mounted in the areas where the superimposed porcelain sections 14, 16 of the support insulator 12 join. A sealing O-ring 44 is inserted between the porcelain sections 14, 16 and circumferentially surrounds the edge 42 of the insulator guide 40 to center the latter.

4 Claims, 3 Drawing Figures

GUIDING ASSEMBLY FOR A HIGH-VOLTAGE CIRCUIT-BREAKER OPERATING ROD

BACKGROUND OF THE INVENTION

1. Field of the Invention

The invention relates to a guiding assembly for a high-voltage circuit-breaker having an insulating operating rod which extends coaxially with clearance inside a hollow support insulator in several superimposed sections to transmit the operating movement from an operating mechanism from the earth potential area to the high voltage potential area where the breaking poles, notably of the arc puffer type, are located, said rod being slide-mounted and guided by at least one guiding insulator extending transversely between the rod and the support insulator at the level where two successive sections of the support insulator are joined.

2. Description of the prior art

High-voltage circuit-breakers, in particular the puffer type, require a large amount of operating energy to move the contacts quickly and to compress the dielectric puffer gas by means of the piston-and-cylinder device. This operating energy is transmitted by a mechanical insulating rod connecting the high potential area with an area close to earth in which the operating mechanism, for example a hydraulic operating mechanism, is located. The circuit-breaker pole(s), or arc chutes, are supported by an insulator post the height of which varies according to the circuit-breaker voltage and can reach several meters. The insulating rod is mounted inside this support insulator post which also constitutes a duct to deliver the dielectric gas to the arc chutes. This insulating rod of great length is capable of transmitting high traction forces used to operate circuit-breaker opening which requires the greatest amount of energy. The closing operation, on the other hand, which is commanded by an operating rod compression force, is limited by the risks of this rod buckling. To avoid this buckling, notably during fast closing of the contacts, a means has already been proposed of guiding the operating rod inside the support insulator by fitting intermediate guiding parts at intervals along this insulator. In a porcelain support insulator in several superimposed sections joined together by metallic flanges in the form of clamps, an intermediate part is inserted between successive metallic clamps. This assembly method, which gives total satisfaction, requires very small manufacturing tolerances especially for the intermediate part in cast insulating material and the clearance between the porcelain of two successive support sections. It also requires sealing and centering rings which increase the cost of manufacture and assembly.

The object of the present invention is to enable an operating rod guiding assembly inside the support insulator to be produced using simple means with high tolerances.

SUMMARY OF THE INVENTION

Two superimposed sections of the porcelain support insulator are mecchanically joined by metallic flanges end to end, sealed at the ends of said sections to form external connection clamps and by fixing bolts securing the pair of end to end flanges. An annular clearance is left between the facing ends of the superimposed porcelain sections, in which clearance a sealing O-ring and the outer edge of the disc-shaped insulator guide are inserted. The flanges are joined together, whereas the outer edge of the disc-shaped insulator guide is simply fitted between the ends of the porcelain sections. A single sealing O-ring is also inserted between these ends of the porcelain sections and externally surrounds the insulator guide, which simplifies tightness problems and allows relatively high clearance margins between the porcelain sections. The divergences in clearance between the porcelain sections and in the diameters of the molded part which constitutes the insulator guide, which is a rough-cast foundry part, are compensated by the elasticity of the O-ring. In order to ensure centering and fixing of the insulator guide, independently from the degree of compression of the O-ring, the insulator guide has on its periphery bosses which cooperate with the internal edge of the O-ring. These bosses provide gaps between the insulator guide and the O-ring, available for compression of the latter.

The O-ring housing is limited by the ends of the porcelain sections, by the insulator guide and on the opposite face by a metal collar the external edge whereof cooperates with the metallic flanges to ensure centering of the latter. The insulator guide is advantageously an epoxy resin molded part, rough-cast from the foundry, and having in its central part an operating rod guiding sleeve. This sleeve, made notably from polytetrafluorethylene, is advantageously secured by clipping into a central orifice of the insulator guide, which avoids machining the latter. The insulator guide has flow vents for the gas contained inside the support insulator.

BRIEF DESCRIPTION OF THE DRAWINGS

Reference is now made to the description of the preferred embodiment, illustrated in the accompanying drawings, in which.

DESCRIPTION OF THE PREFERRED EMBODIMENT

Figure 1:
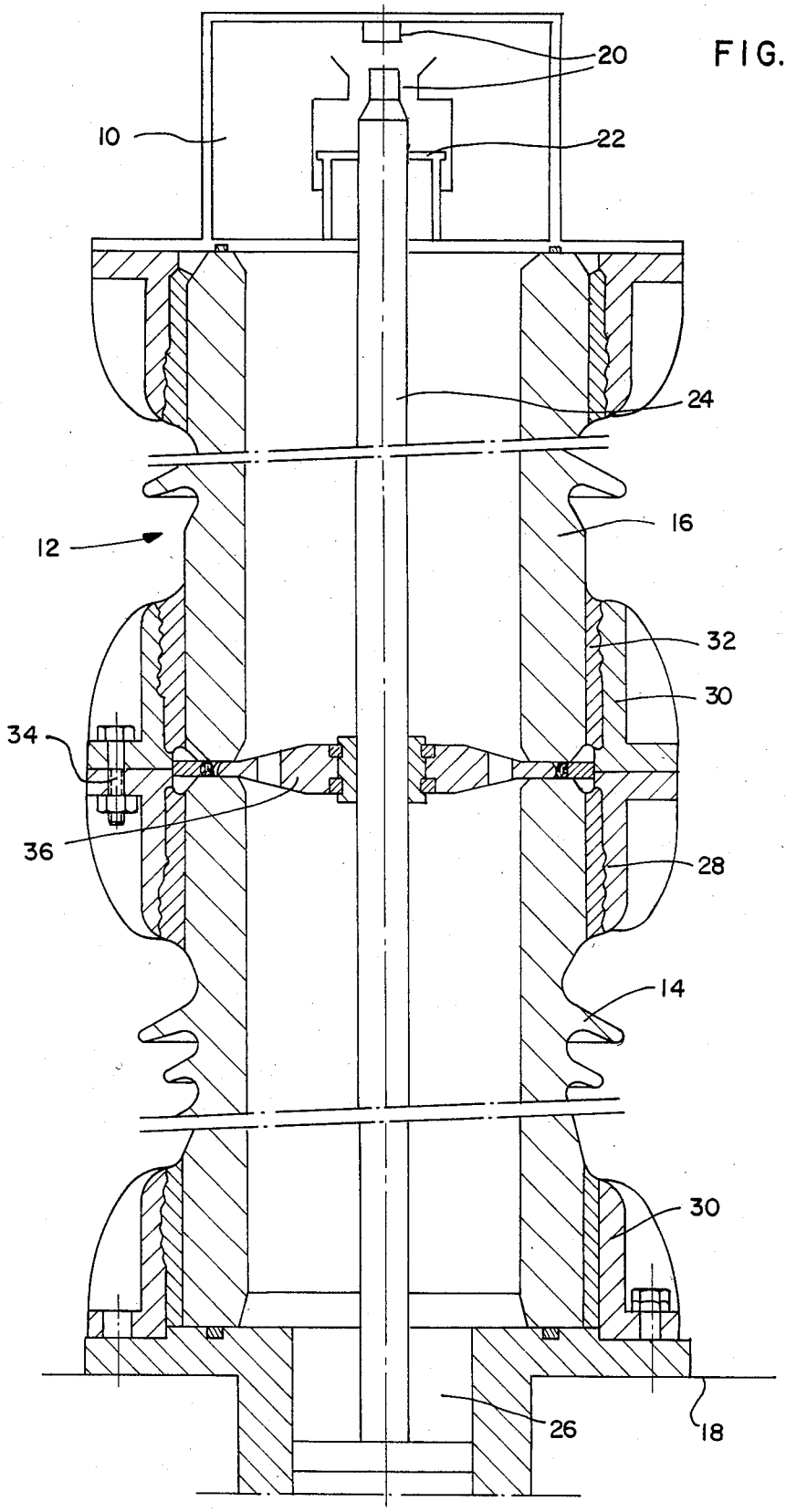
FIG. 1 illustrates diagrammatically a sectional side view of a circuit-breaker having an operating device embodying the invention.
Figure 2:
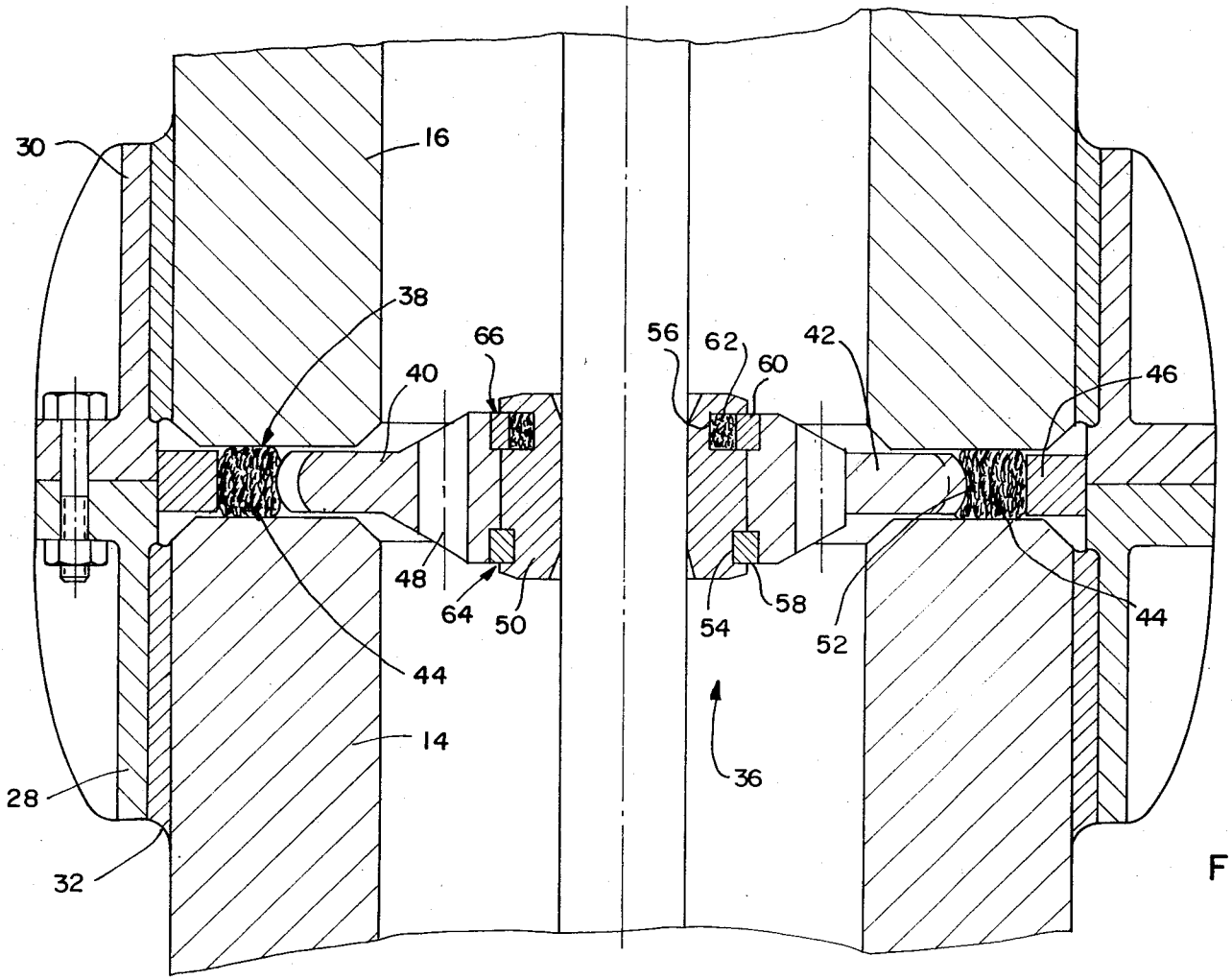
FIG. 2 is a view on a larger scale of a detail of FIG. 1.
Figure 3:
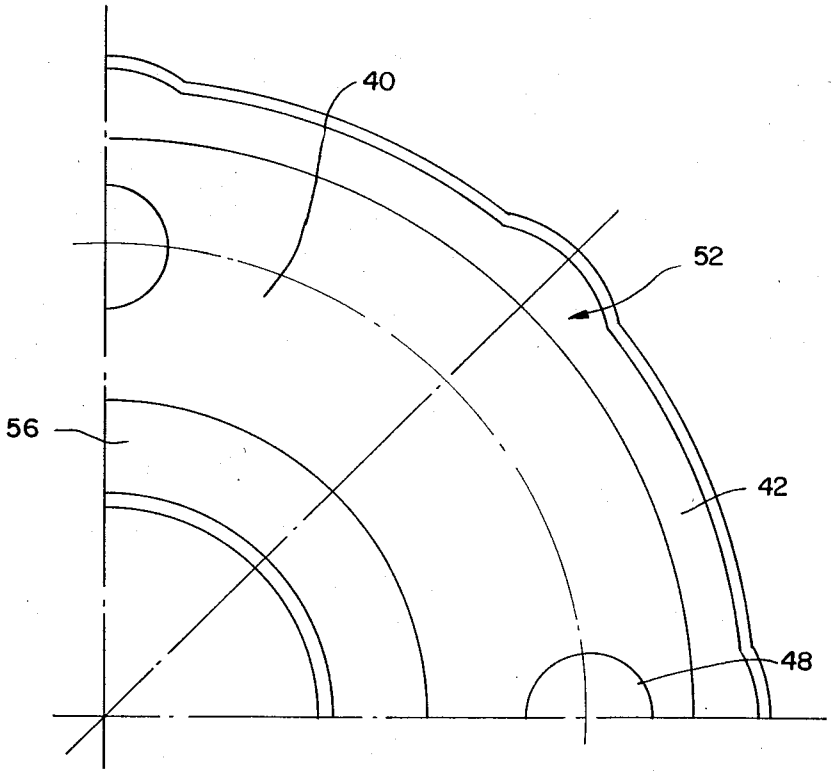
FIG. 3 is a fragmentary view of the insulator guide of FIG. 1.

In the embodiment shown in FIGS. 1 to 3, a high-voltage puffer circuit-breaker arc chute 10 is supported by a support insulator post 12 made up of two superimposed sections 14, 16 secured to a pedestal 18 placed on the ground. The support insulator 12 can quite easily support two arc chutes 10 mounted in a V, each of these arc chutes having a pair of separable contacts 20 and a piston-and-cylinder assembly 22 puffer gas compression device, in this case for the $SF_6$ gas contained in the arc chute 10. The movable contact 20 is secured to an operating rod 24 which extends coaxially inside the hollow cylindrical-shaped support insulator 12. The insulating operating rod 24 is fixed at its lower part to an operating mechanism comprised for example of a hydraulic jack 26 which is able to command opening and closing of the contacts 20 by movement of the rod 24. For high voltages, the support insulator 12 may have a larger number of superimposed sections 14, 16, the height of the assembly being able to reach several meters. The insulator 12 limits a sealed enclosure filled with $SF_6$ gas, this enclosure advantageously being in communication with the arc chute 10. Each hollow cylindrical porcelain sections 14, 16 has at its ends metal flanges 28, 30 sealed by cement 32. The flanges 28, 30 in the form of clamps are assembled by bolts 34.

Circuit-breakers of this kind are well-known to those skilled in the art, and it is sufficient to give a reminder that the tripping or contact 20 opening operation is commanded by a downward slide of the jack 26 and of the operating rod 24 which operates in traction. A closing operation is brought about by upward movement of the rod 24 which operates in compression. To avoid the operating rod 24 buckling in compression, intermediate parts 36 are fitted at intervals along the support insulator 12 to guide the rod 24.

The present invention is more particularly concerned with these intermediate parts described in more detail below referring to FIG. 2.

The intermediate part 36 is mounted in the sealing area of the superimposed sections 14, 16 and extends in a transverse plane perpendicular to the rod 24. The flanges 28, 30 in the form of clamps are joined together, the assembly being made in such a way that a gap 38 is left between the ends of the porcelain sections 14, 16 when the metal flanges 28, 30 are joined together. The intermediate part 36 comprised of a disc-shaped insulator guide 40 enters the gap 38 through its external circumference 42. An elastic O-ring 44 is also housed in the gap 38, circumferentially surrounding the edge or circumference 42 of the disc 40. The O-ring 44 is in turn circumferentially surrounded by a metal collar 46 the internal edge of which enters the gap 38 and the external edge of which cooperates with the flanges 28, 30 to center the superimposed flanges 28, 30. The disc 40 has flow vents 48 for the gas contained in the support insulator 12 and an operating rod 24 guiding sleeve 50. The elastic O-ring 44 inserted between the porcelain sections 14, 16 ensures that the junction between these sections 14, 16 is tightly sealed.

It enables divergences in clearance between the opposing faces of the sections 14, 16 which determine the gap 38 to be compensated. To ensure that the disc 40 is centered whatever the compression of the elastic O-ring 44 while allowing different degrees of compression of this O-ring, bosses 52 are provided at regular intervals on the circumference 42 of the disc 40. In the right hand part of FIG. 2, the O-ring 44 is opposite a boss 52 and the compressed O-ring 44 completely fills the gap 38 preventing any lateral movement of the disc 40. In the left hand part of FIG. 2, the O-ring 44 is shown in an area without bosses 52 leaving a gap 38 for further compression of the O-ring 44. The disc 40 is sufficiently well centered and prevented from moving by the number of bosses 52 at regular intervals around its circumference. It can be clearly seen that the system embodied in the invention of an O-ring 44 and disc 40 centering by the bosses 52 allows for divergences in the diameters of the disc 40 which can be rough-cast.

The operating rod 24 guiding sleeve 50 is fixed by clipping into the central orifice of the disc 40. In the example shown in FIG. 2, the sleeve 50 has two circular grooves 54, 56 each of which accommodates a locking ring 58, 60, the ring 58 permanently protruding out of the groove 54 whereas the ring 60 is fitted so that it can take up a retracted position inside the groove 56. An elastic seal 62 bears on the ring 60 in the protruding position. The edges of the central orifice of the disc 40 have circular grooves 64, 66 open respectively downwards and upwards. The sleeve 50 is fitted in the following way. Keeping the ring 60 in the retracted position, the sleeve 50 is slid upwards into the central opening of the disc 40 until the ring 60 is opposite the upper groove 66 and clips into the latter. In this position of the ring 60 which prevents any downward movement of the sleeve 50, the ring 58 is wedged up against the bottom of the groove 64 preventing any upward movement of the sleeve 50. This sleeve 50 is therefore retained on the disc 40 by simple clipping, the grooves 64, 66 can be rough-cast and do not require any machining of the disc 40.

This assembly is particularly simple and easy to fit, the number of parts making up this assembly being limited. Manufacturing tolerances are compensated by the elasticity of the O-ring 44, the mechanical connection between the superimposed sections 14, 16 being perfectly performed by the joined flanges 28, 30. Insulator guides 40 can be fitted between each superimposed section 14, 16 junction or only at some of these junctions when risks of buckling are limited. The invention is of course not restricted to the embodiment described and illustrated.

What we claim is:

1. A high-voltage circuit-breaker operating device having a mechanism in a zone of ground potential and an arc-extinguishing chamber, notably an arc puffer device, in the high-voltage potential area, comprising:
   - a hollow support insulator in several superimposed sections, each section comprising a cylindrical porcelain body and flanges in the form of clamps, sealed to the ends of the sections and slightly protruding from the latter, the clamps of two adjacent sections being mounted end to end and secured by bolts, an annular gap being left between the ends of the porcelain bodies facing each other,
   - an insulating operating rod which extends coaxially inside the hollow insulator to transmit movement from the operating mechanism to the arc-extinguishing chamber,
   - an insulating disc having an external edge inserted with a small amount of clearance in said annular gap and a central orifice guiding the sliding rod,
   - an O-ring housed in said gap to ensure tightness between the sections, said O-ring circumferentially surrounding the external edge of the disc to position the latter.

2. An operating device according to claim 1, wherein a centering collar has an internal edge inserted in said gap circumferentially surrounding the O-ring and an external edge bearing on the inside of the clamps.

3. An operating device according to claim 2, wherein the external edge of the insulating disc has radial bosses cooperating with the internal edge of the O-ring to form local bearing points leaving clearances compatible with manufacturing tolerances.

4. An operating device according to claim 1, wherein the operating rod slides with a small amount of clearance through a guide sleeve which is fixed by clipping into the central orifice of the insulating disc.

* * * * *